US008231127B2

(12) United States Patent
Hercog

(10) Patent No.: US 8,231,127 B2
(45) Date of Patent: Jul. 31, 2012

(54) GAMING APPARATUS COMPRISING BALLS FOR A GAME OF CHANCE

(75) Inventor: Ivan Hercog, Brezovica pri Ljubljani (SI)

(73) Assignee: Zuum d.o.o., Kranj (SI)

( * ) Notice: Subject to any disclaimer, the term of this patent is extended or adjusted under 35 U.S.C. 154(b) by 0 days.

(21) Appl. No.: 12/737,337

(22) PCT Filed: Jun. 26, 2009

(86) PCT No.: PCT/SI2009/000025

§ 371 (c)(1),
(2), (4) Date: Apr. 19, 2011

(87) PCT Pub. No.: WO2010/002357

PCT Pub. Date: Jan. 7, 2010

(65) Prior Publication Data

US 2011/0254224 A1 Oct. 20, 2011

(30) Foreign Application Priority Data

Jul. 1, 2008 (SI) ..... 200800170

(51) Int. Cl.
*A63B 71/00* (2006.01)

(52) U.S. Cl. ..... 273/144 B

(58) Field of Classification Search ..... 273/144
See application file for complete search history.

(56) References Cited

U.S. PATENT DOCUMENTS

| | | | | |
|---|---|---|---|---|
| 1,796,937 | A * | 3/1931 | Nadeau et al. | 124/56 |
| 4,575,081 | A * | 3/1986 | Cavanagh | 473/460 |
| 4,601,471 | A * | 7/1986 | Frank | 273/144 B |
| 4,786,056 | A * | 11/1988 | Dunnigan | 273/144 A |
| 5,014,991 | A * | 5/1991 | Mirando et al. | 463/16 |
| 5,050,880 | A * | 9/1991 | Sloan | 273/144 B |
| 5,121,920 | A * | 6/1992 | Laezzo et al. | 273/144 B |
| 6,688,297 | B1 * | 2/2004 | Clague | 124/44.5 |
| 6,702,668 | B2 * | 3/2004 | Banyai | 463/17 |
| 7,775,521 | B1 * | 8/2010 | Itkis et al. | 273/144 B |

FOREIGN PATENT DOCUMENTS

EP 1548669 6/2005

* cited by examiner

*Primary Examiner* — Alvin Hunter
*Assistant Examiner* — Dolores Collins
(74) *Attorney, Agent, or Firm* — Jacobson Holman PLLC

(57) ABSTRACT

Gaming apparatus including balls for a game of chance with a housing having at least a partly transparent space with balls. Each individual ball indicates one unit of jackpot value and the number of balls is higher than the number of units making up a jackpot. It further includes at least one tube for blowing in pressurized air to the space, a control unit, a member for the creation of air flow under pressure and a member for raising and sinking of posts. The bottom of the space is provided at least in one part with at least one recess, so that all static balls always lie in a group within the recess. Vertically movable posts with a bearing on the top for only one ball are located within the recess. Air flow blown into the space moves the balls at random and after air flow is discontinued, balls stop in groups in the recess at the bottom, the posts are raised and each selects one ball, the value units of which make up each jackpot.

5 Claims, 1 Drawing Sheet

GAMING APPARATUS COMPRISING BALLS FOR A GAME OF CHANCE

Figure 1:
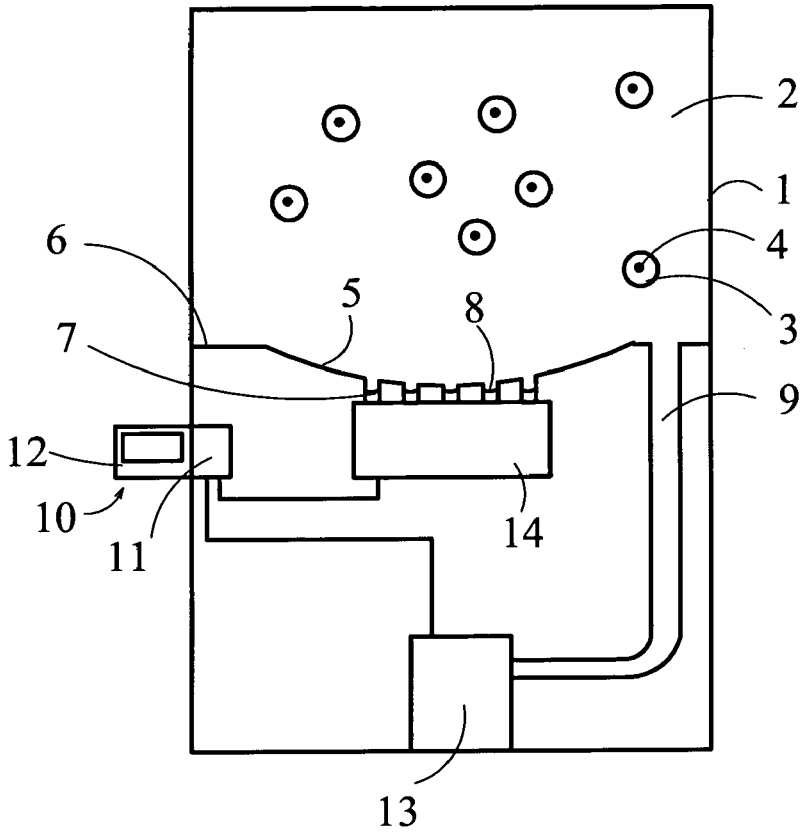

This is a national stage of PCT/SI09/000025 filed Jun. 26, 2009 and published in English, which has a priority of Slovenia no. 2008 0 0170 filed Jul. 1, 2008, hereby incorporated by reference.

SUBJECT OF INVENTION

The subject of the present invention is a gaming apparatus comprising balls for a game of chance that is adequate for individuals or groups of people to play in casinos and other public premises and it is also applicable as an automatic device for random creation of jackpots in mass games of chance, e.g. lottery and the like.

TECHNICAL PROBLEM

A technical problem solved by the present invention is how to configure such apparatus for a game of chance that will not only comply with the internationally prescribed randomness of jackpots but also provide for a higher level of psychological thrill to players and viewers in the final phase of the drawing of a jackpot, which should be created in one step, wherein the apparatus should offer a possibility to select several games and a possibility of automatic consecutive optional number of games without any need for a manual intervention in the apparatus.

PRIOR ART

Known apparatus of this type are configured only for public presentation of procedures of generating jackpots, e.g. lottery. They are formed as closed, transparent containers comprising balls with indicated values representing one jackpot element each. Pressurised air flow makes the balls move within the space at random. Such apparatus is further equipped with a transparent tube led to this closed space and is preferably vertical. After shuffling the balls for a certain period of time air flow under increased or decreased pressure within said tube presses a random ball present in the vicinity of the opening of the tube in the space with balls towards its opposite end outside the space with balls. This may be carried out by way of a timer or through manual intervention. The selected ball bearing an indication of value represents one unit of a jackpot. To obtain the remaining units of the jackpot, the procedure is repeated in the same apparatus or a separate apparatus is foreseen for each unit of the jackpot. Since individual value units of the jackpot are created consecutively one at a time, the game is exciting, yet lengthy. If more games are played consecutively by one player or a group of players, there is a need for a shorter duration of one game.

SOLUTION TO THE TECHNICAL PROBLEM

The described technical problem is solved by an apparatus of the invention, which is characterised in that there are more balls within the space containing balls bearing various jackpot values, one value on each ball, wherein after the completion of shuffling of balls after a predetermined period of time, when the balls get still at the bottom of the appliance in a group of adjacent balls, the apparatus automatically separates the number of balls defining the total jackpot value. A new game begins after the balls determining a jackpot are automatically returned to the interior of the container and air flow is blown in again. The apparatus of the invention also comprises a computer control unit that entirely autonomously executes the procedure and also offers a player a possibility to select a game of chance and keeps records of payments and payoffs of the jackpot.

Figure 2:
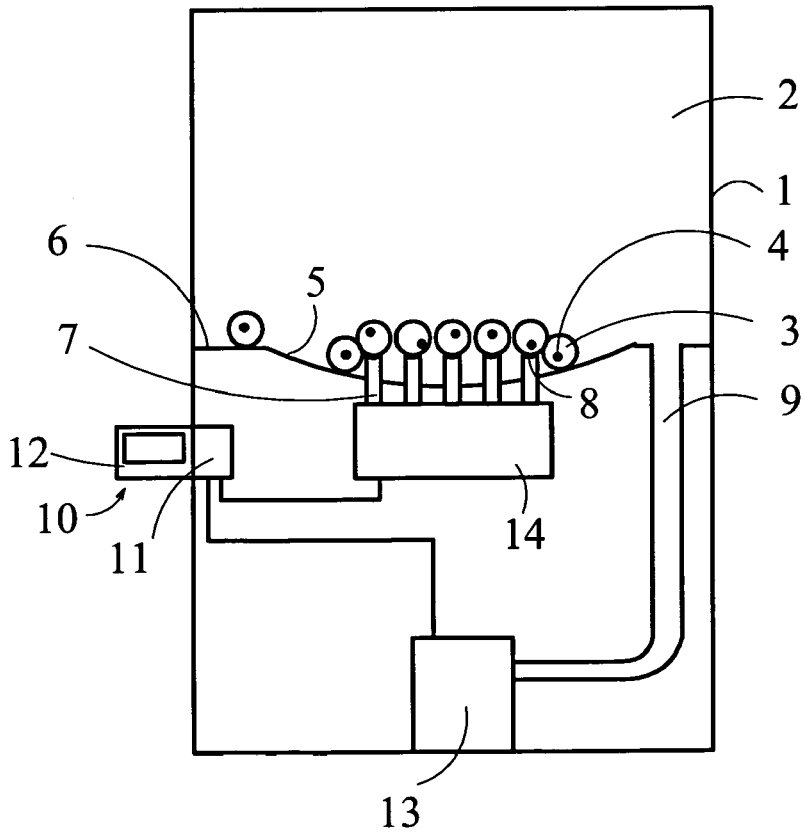

The characteristics of the invention are disclosed in more detail by way of an embodiment and the enclosed drawing, showing in FIG. 1 longitudinal cross-section of a schematically shown apparatus of the invention in the situation, in which balls randomly move; and FIG. 2 longitudinal cross-section of a schematically shown apparatus of the invention in the situation, in which a jackpot is created.

The gaming apparatus comprising balls for a game of chance consists of a housing 1 of an optional shape and intended to be optionally designed for individual needs. Within the housing there is at least a partly transparent space 2 with balls 3, wherein each individual ball 3 indicates one unit 4 of jackpot value and the number of balls is much higher, as a rule considerably higher than the number of units 4 making up a jackpot. The bottom of said space 2 is provided at least in one part with at least one recess 5, so that either all balls 3, when static, lie in group within said recess 5, or that said group consists of a larger number of balls 3 than the number of units 4 making up a jackpot and not of all balls 3, wherein the remaining balls 3 are located in the vicinity on the bottom. Fields 6 outside said recess 5 may also represent the elements for determining additional parameters of the jackpot with respect to the number of balls 3 present in these fields 6.

Said recess 5 disposes over vertically movable posts 7 with a bearing 8 on the top for only one ball 3. The number of posts 7 equals the largest number of units 4 to determine the value of each jackpot depending on the possibility of game selection. There may also be more posts 7 within said space 2, yet only as many are selected to lift said balls 3 by a control unit in each game as defined by a selected game. This brings diversity in the assortment of games. Said bearings 8 are preferably configured as recesses.

Said posts 7 are arranged within said recess 5 in a way that the mutual distance between centres of said bearings 8 equals the diameter of said balls 3.

At least one tube 9 for blowing in pressurised air is led to said space 2. Air shuffles all balls 3 at random within said space 2.

A control unit 10 consists of two parts. One part 11 automatically carries out all steps needed for the execution of an individual game in order to ensure an adequate level of randomness of shuffling of balls 3 and at the end the arrangement of static balls 3 within said recess 5 and in the final phase for the selection and positional drawing of those balls 3 determining the value of each jackpot. A second part 12 of said control unit 10 is foreseen as a user's interface allowing a player or players to select a type of an individual game and all the necessary matters concerning the payments and payoffs of bets. Said second part 12 is configured as a computer keyboard, preferably this is a computer touch screen.

The apparatus further comprises a member 13 of an optional shape for the creation of air flow under pressure and a member 14 for raising and sinking of posts 7. The number of raised/sunk posts 7 equals the number of units that create a value of each jackpot. Said member 14 is preferably configured as a pneumatic cylinder, it may also be driven by an electric motor or an electromagnet.

All members and units are electrically connected to be automatically controlled by said control unit 10.

In order to prevent said balls 3 from getting charged with static electricity, which results in a temporary merger of said balls 3 into groups, which decreases the level of randomness of the game, at least the surface of said recess 5 is coated with a polychloroprene (Neoprene®) coating.

The gaming apparatus comprising balls for a game of chance operates as follows: a player selects a type of game via second part 12 and pays in the sum of the bet. The mode of treatment of payments and payoffs is not of special interest in this disclosure, since known variants of this type are entirely applicable with the apparatus of the invention. After the completion of all steps that need to be performed by a player and when all balls 3 lie still on the bottom of said space 2 or randomly travel within it, a period starts, in which air flow forces said balls 3 within said space 2 to randomly travel around for a certain period of time. It is possible to additionally increase the randomness of the movement of balls 3 by changing the intensity of the air flow, which also increases the thrill of the players.

After said balls 3 have shuffled within said space 2 for a predetermined time, said part 11 of the control unit discontinues blowing in the air flow. All balls 3 or only a part thereof, depending on the type of game and the shape of the bottom, fall into said recess and form a group. The posts 7 are then raised, i.e. as many posts as there are the units that create a jackpot. A player watches the value of the jackpot appearing. The way said posts 7 are raised may present an additional element of excitement of an individual type of game. Said posts 7 may get raised all at once, consecutively or even selected ones with respect to the type of game. The apparatus thus offers a wider spectre of games, a possibility of a jackpot. The jackpots may be classified in types as to the number of units and the height of the jackpot.

Apart from design and graphical final touch said space 2 may be equipped with optional light effects. A sound coulisse is also possible.

The invention claimed is:

1. Gaming apparatus comprising a housing having a partly transparent space with balls, wherein each individual ball indicates one unit of jackpot value and the number of balls being much higher than the number of units making up a jackpot, at least one tube for blowing in pressurized air to said space, a control unit, a member for creation of air flow under pressure and a member for raising and sinking of posts, a bottom of said space being provided at least in one part with at least one recess so that all static balls always lie in a group within said recess, or that said group consists of a larger number of balls than the number of units making up a jackpot and not of all balls, wherein the remaining balls are located in the vicinity on the bottom, wherein vertically movable posts with a bearing on the top for only one ball are located within said recess.

2. Apparatus as claimed in claim 1, wherein the number of said posts equals the largest number of units to determine the value of each jackpot depending on the possibility of game selection.

3. Apparatus as claimed in claim 1, wherein said bearings are configured as recesses.

4. Apparatus as claimed in claim 1, wherein said posts are arranged within said recess in a way that the mutual distance between centers of said bearings equals the diameter of said balls.

5. Apparatus as claimed in claim 1, wherein at least the surface of said recess is coated with a polychloroprene coating.

* * * * *